US008322050B2

(12) United States Patent
Lubart

(10) Patent No.: US 8,322,050 B2
(45) Date of Patent: Dec. 4, 2012

(54) OUTSOLE TREAD PATTERN

(75) Inventor: Randy N. Lubart, Palm Beach Gardens, FL (US)

(73) Assignee: Shoes For Crews, LLC, West Palm Beach, FL (US)

( * ) Notice: Subject to any disclaimer, the term of this patent is extended or adjusted under 35 U.S.C. 154(b) by 28 days.

(21) Appl. No.: 12/940,126

(22) Filed: Nov. 5, 2010

(65) Prior Publication Data

US 2012/0110876 A1 May 10, 2012

(51) Int. Cl.
*A43B 23/28* (2006.01)
*A43C 15/00* (2006.01)

(52) U.S. Cl. ..... 36/59 R; 36/59 C; D2/960

(58) Field of Classification Search ..... 36/25 R, 36/32 R, 59 R, 59 C, 134; D2/908, 951–953, D2/959, 960
See application file for complete search history.

(56) References Cited

U.S. PATENT DOCUMENTS

| | | | | |
|---|---|---|---|---|
| 3,717,943 | A | 2/1973 | Orndorff, Jr | |
| 3,747,237 | A * | 7/1973 | Wilowski | 36/59 C |
| 4,107,858 | A * | 8/1978 | Bowerman et al. | 36/134 |
| 4,202,116 | A | 5/1980 | Dassler | |
| 4,274,211 | A | 6/1981 | Funck | |
| 4,307,521 | A * | 12/1981 | Inohara et al. | 36/31 |
| 4,375,728 | A * | 3/1983 | Dassler | 36/32 R |
| D479,643 | S * | 9/2003 | O'Shea et al. | D2/951 |
| 7,047,672 | B2 | 5/2006 | Hoffer et al. | |
| 7,703,221 | B2 | 4/2010 | Richards et al. | |
| 2002/0078598 | A1 * | 6/2002 | Bell | 36/59 R |
| 2009/0188132 | A1 | 7/2009 | Fujikawa et al. | |

* cited by examiner

*Primary Examiner* — Khoa Huynh
*Assistant Examiner* — Melissa Lalli
(74) *Attorney, Agent, or Firm* — McHale & Slavin, P.A.

(57) ABSTRACT

A footwear sole includes an upper surface and a lower surface. The lower surface includes a plurality of tread members formed thereon. The tread members include a plurality of projections or lugs of various sizes and shapes which are grouped together into specific patterns. The material from which the projections are formed increases the shoe sole's ability to resist slipping on floor surfaces which are covered with oil, water, soap, etc. The shape and pattern of the projections or lugs enable them to resist flexing and disengaging the floor surface. This increases the footwear sole's ability to resist slipping.

8 Claims, 4 Drawing Sheets

OUTSOLE TREAD PATTERN

FIELD OF THE INVENTION

The present invention relates generally to footwear, and in particular to a sole assembly for use in footwear such as shoes, sandals or the like.

BACKGROUND OF THE INVENTION

It is well known to make the sole of a shoe from rubber or a rubber compound. This type of shoe construction provides especially beneficial results when utilized on shoes which are normally worn in wet or damp environments. For example, shoes which are worn by individuals in the food preparation industry, or where a large quantity of water or fluids is utilized in the manufacture of products.

Many industries or companies employ floors which are covered by materials which resist the penetration of fluids or other substances. These materials are utilized so that any substances inadvertently spilled on the floor can be quickly and completely removed from the floor. One of the drawbacks to these types of floor coverings is that whenever water or other fluids are spilled on these floors, they become very slippery. One example of this is the floor coverings utilized in hospitals and other health care institutions. Individuals who work in these environments need to wear shoes which will provide them protection from falls whenever they encounter wet floors.

DESCRIPTION OF THE PRIOR ART

Many different shoe soles have been proposed to prevent an individual from slipping. In U.S. Pat. No. 3,717,943 the sole of a boot or overshoe is made from rubber and includes fins and grooves. The fins cooperate with the grooves to trap air within the grooves. The air facilitates the self cleaning feature of the boots which removes mud and other substances from the soles of the boots.

U.S. Pat. No. 4,202,116 discloses a tread for a sport shoe which includes a sole having projections extending outwardly from a tread surface. The tread includes a one-piece, thin walled, metal part with at least two separate, dimensionally reinforced surface sections bearing the integrally molded projections. The reinforced surface includes a plurality of embossed, smooth-surfaced and beveled projections. The metal part is fixedly secured to an inner surface of the shoe sole by either a thin wire grid embedded in the synthetic resin sole or uniformly distributed perforations.

U.S. Pat. No. 4,274,211 discloses a shoe sole made of flexible rubber material with a non-slip profile. The sole includes a plurality of various sized projections or layered elements. The elements include surfaces which are made from materials that are slip resistant. In addition to being slip resistant, the structure and spacing of the projections prevents the accumulation of mud and other debris on the soles of the shoes.

U.S. Pat. No. 7,047,672 discloses a shoe sole which is designed to be used on a sand surface. The sole is made from a compressed material having an upper surface and a lower surface. A peripheral lip projects downwardly from the lower surface of the sole. A plurality of fins also project downwardly from the lower surface. This type of construction enables efficient propulsion in sandy environments.

U.S. Published Patent Application No. 2009/0188132 discloses a slip resistant shoe sole which includes a plurality of ground contacting projections. The ground contacting projections are V-shaped and are spaced from one another by a predetermined distance in a longitudinal direction of the sole of the shoe. The V-shaped projections also include reinforcements at their base. The projections are made from an elastomeric polymer with a specific JIS-A hardness. This material increases the shoe's ability to resist slipping, and the shape of the projections increases their resistance to avoid bending and deformation.

U.S. Pat. No. 7,703,221 discloses a sole assembly for a shoe which includes a flexible base having an underside surface which includes a forward region, a rearward region, and an intermediate region therebetween. The sole includes a plurality of individual sole elements on the underside thereof. Each element includes a body portion and a connecting section which is operatively secured to the underside surface of the flexible base. The sole elements are arranged on the underside surface of the flexible base such that adjacent sole elements have overlapping sections.

SUMMARY OF THE INVENTION

A footwear sole includes an upper surface and a lower surface. The lower surface includes a plurality of tread members formed thereon. The tread members include a plurality of projections or lugs of various sizes and shapes which are grouped together into specific patterns. The material from which the projections are formed increases the shoe sole's ability to resist slipping on floor surfaces which are covered with oil, water, soap, etc. The shape and pattern of the projections or lugs enable them to resist flexing and disengaging the floor surface. This increases the footwear sole's ability to resist slipping.

Accordingly, it is an objective of the instant invention to provide a slip resistant sole for footwear which enables an individual to safely walk on smooth floor surfaces and/or floor surfaces which are covered with water, oil, soap, etc.

It is a further objective of the instant invention to provide a footwear sole which can be readily manufactured by molding.

It is yet another objective of the instant invention to provide a footwear sole which includes a plurality of projections which enables an individual to safely walk on smooth floor surfaces and/or floor surfaces which are covered with water, oil, soap, etc.

It is a still further objective of the invention to provide a footwear sole which includes a pattern of tread members which enables an individual to safely walk on smooth floor surfaces and/or floor surfaces which are covered with water, oil, soap, etc.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
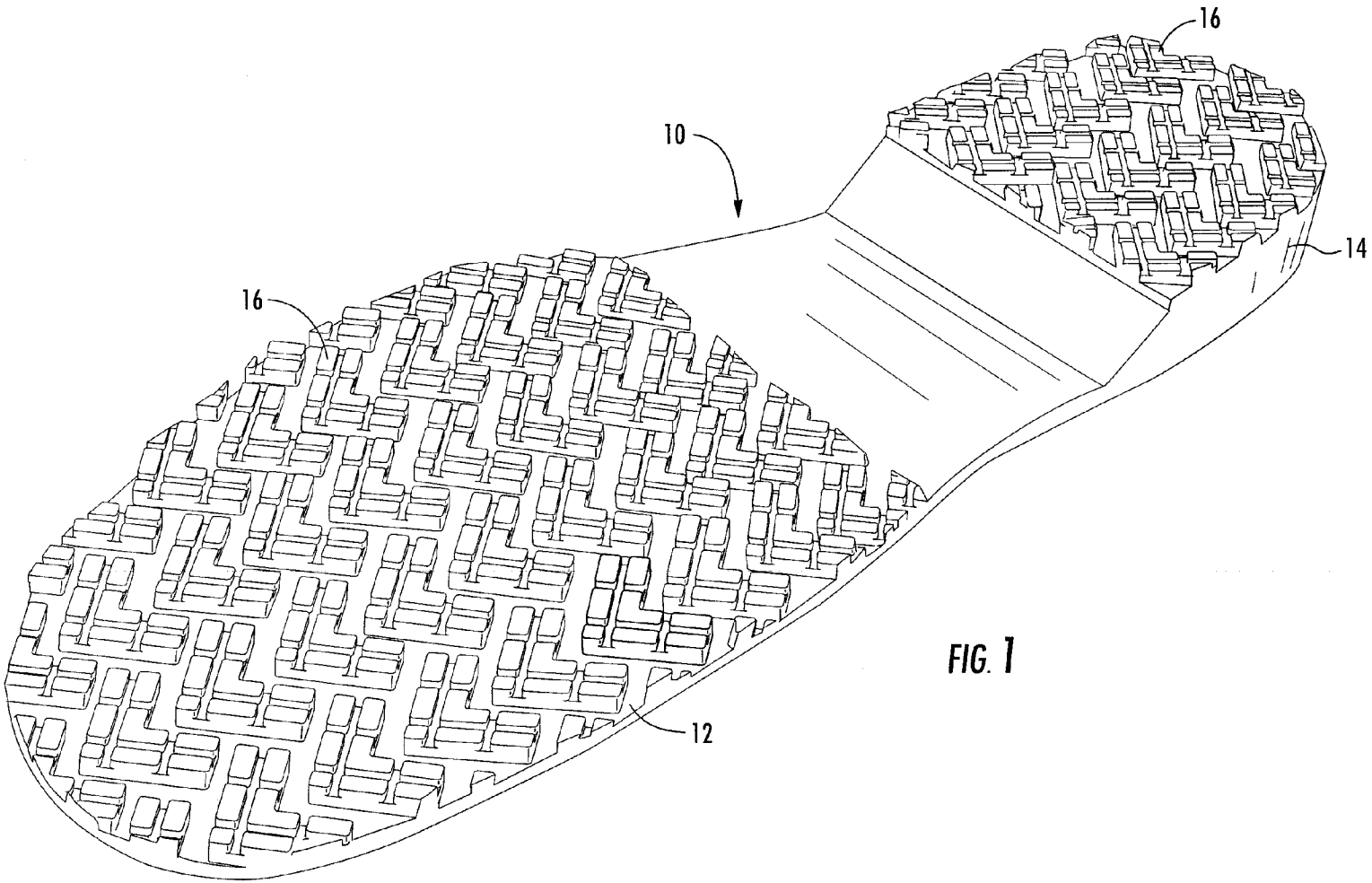
FIG. 1 is a bottom isometric view of a footwear sole of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
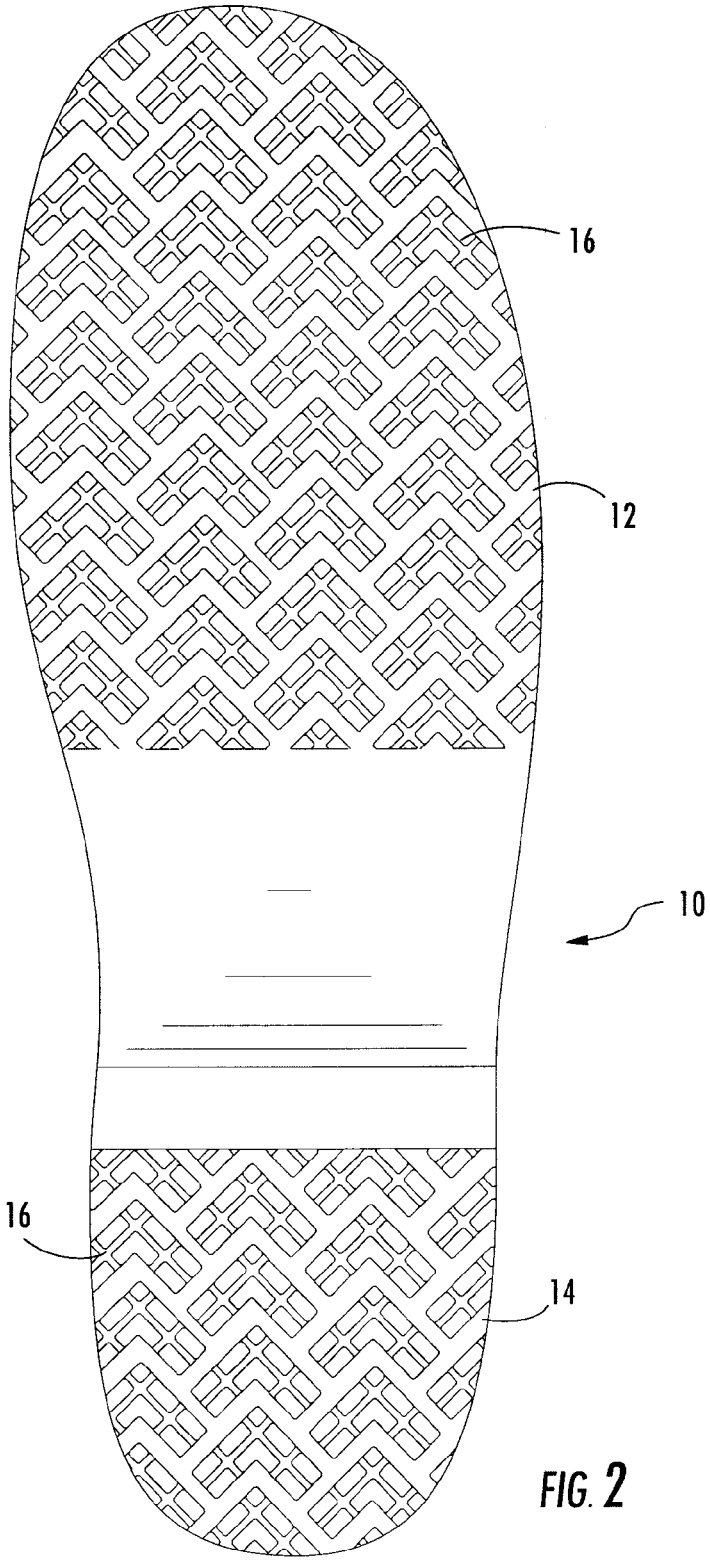
FIG. 2 is a bottom plan view of a footwear sole of the present invention.

The present invention combines a footwear sole made from a slip resistant material and having a unique tread pattern. The tread pattern is illustrated in FIGS. 1 and 2. Details of the tread are illustrated in FIGS. 3-6. As seen in FIGS. 1 and 2, a footwear sole 10 includes an outsole 12 and a heel 14. "Footwear" as used herein, is defined as any type of wear suitable for use on a foot such as, for example, a shoe, a boot, a sandal, an overshoe, etc. An "outsole", as used herein, is defined as any layer or member of a footwear that defines in part an outermost bottom facing surface of footwear. A plurality of unique tread members 16 are secured to both the outsole 12 and heel 14. The preferred embodiment of the present invention includes a heel that is integral with the outsole. However, the heel can also be formed as a separate member from the outsole and secured thereto. The tread members 16 are preferably arranged in a chevron or V-shaped pattern with the point of the V in the direction of the front of the footwear. While this is the preferred pattern or design, other designs and/or patterns can also be employed. In a preferred embodiment, illustrated in FIGS. 1 and 2, there is a portion of the outsole 12 between a forward portion of the outsole 12 and the heel 14 which does not include tread members 16.

Details of the tread members 16 are illustrated in FIGS. 3-6. Each tread member 16 includes a base 18 and a plurality of projections or lugs 20. The tread members also include longitudinal channels 22 and transverse channels 24. The function of these channels will be described hereinafter. The tread members are made from a unique slip resistant material. The slip resistant material has a hardness of about 0.49 Shore, based on tests performed on a Durometer Hardness Tester. The material also has a slip resistance rating of 0.56-0.65 when tested on a Brungraber Mark 2 Articulated Strut Slip Testing Device. A slip resistant surface is defined as a surface having a rating or 0.50 or higher when tested on the Brungraber Mark 2 Articulated Strut Slip Testing Device.

Figure 3:
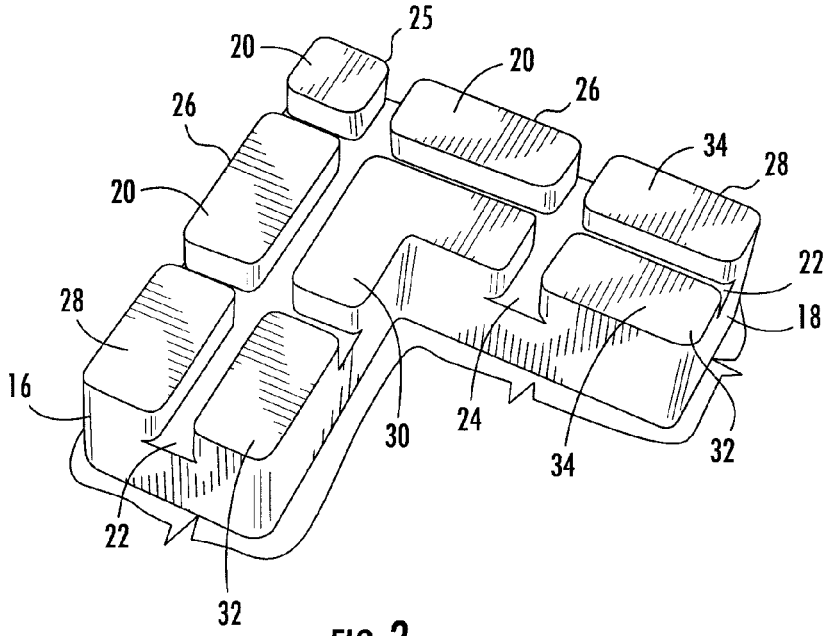
FIG. 3 is a rear perspective view of a group of projections.
Figure 4:
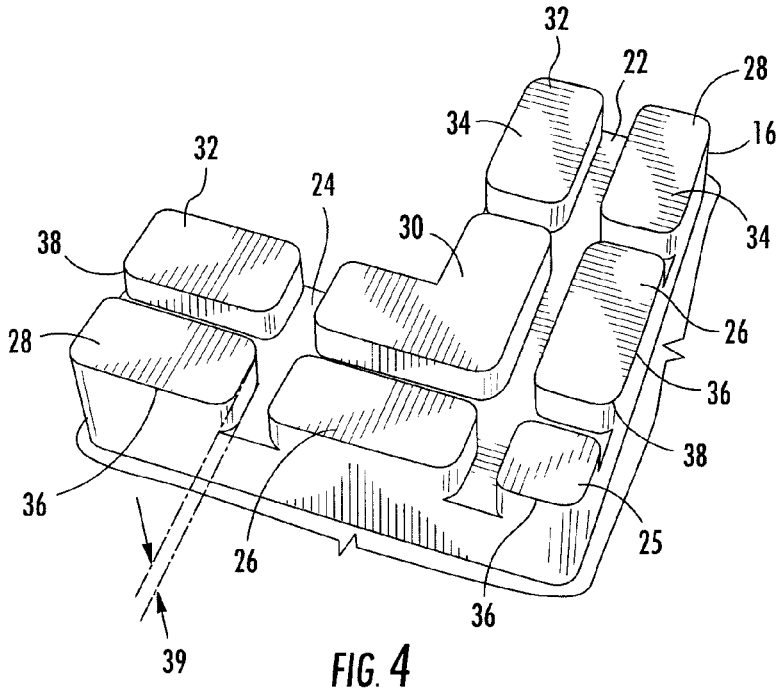
FIG. 4 is a front perspective view of a group of projections.

Referring to FIGS. 3 and 4, each of the preferred chevron shaped tread members include a lead projection 25 which is square shaped in cross section. Spaced from projection 25 and on two sides are projections 26. Projections 26 are rectangular in cross section. Spaced from the end portions of projections 26 are projections 28. Projections 28 are also rectangular in cross section. Spaced from projections 26 is a V-shaped projection 30. Spaced from the ends of projection 30 and substantially parallel to projections 28 are projections 32. Projections 25-32 are preferably integrally formed onto the base 18. Each of the projections 25-32 include an upper surface 34 which is in contact with a floor or other surface onto which the shoe is placed.

The material from which the tread members 16 are formed provides slip resistance to the footwear when wet, smooth, or other slippery surfaces are encountered by the tread members. This material also provides stability to the projections 25-32 so that they will resist flexing and deformation when slid along a floor or other surface. Deformation of the projections will result in the upper surface 34 of the projections not completely engaging the floor or surface. Deformation of the projections will result in less slip resistance of the tread members and footwear. The material of the tread members also cannot be too hard or it will not be able to provide the proper amount of slip resistance to the tread members.

Figure 5:
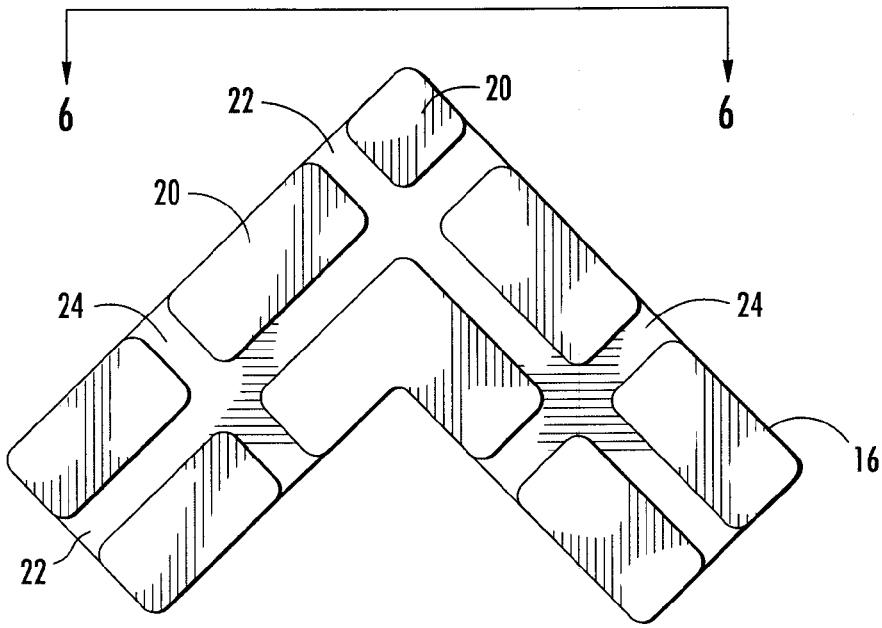
FIG. 5 is a top plan view of a group of projections.
Figure 6:
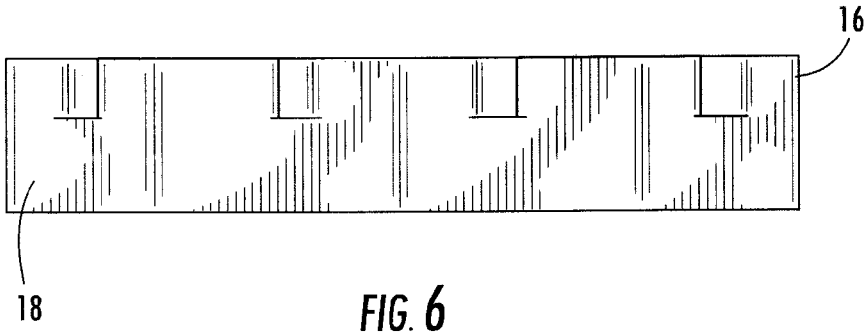
FIG. 6 is a front plan view of the group of projections taken along line 6-6 in FIG. 5.

When an excessive amount of water, oil, or other fluids are encountered on a floor it is essential to direct these fluids away from the projections 25-32. This is accomplished with channels 22 and 24. As illustrated in FIG. 5, the tread member 16 is pointed upwardly in the direction of travel of the footwear. When water, oil or other fluids are encountered on a floor or other surface, the fluids are channeled away from the upper surfaces 34 of the projections by channels 22 and 24. This enables the upper surfaces 34 of the projections to completely contact the floor or other surface and provide slip resistance to the footwear. The transverse channels 24 aid in removing fluids from the longitudinal channels 22 and provide a path for fluids which encounter the sides of the tread members 16.

The sharp edges 36 of the projections 25-32 function to squeegee fluids, such as water or oil, from a floor or other surface to assist in preventing the footwear from slipping on these surfaces. The edges 36 will push or direct fluids on the floor or other surfaces away from the upper surface 34 of the projections 25-32 as the footwear moves along a floor or surface. This prevents the fluids from coming between the projections 25-32 and the floor or other surface which in turn enables the upper surfaces 34 of the projections to fully contact the floor or other surface on which the footwear is moving. The rounded corners 38 of projections 25-32 assist in directing the fluids into channels 22 and 24 and away from upper surfaces 34 of projections 25-32. The sharp edges 36 of the projections are especially useful on portions of the outsole which are not firmly placed in contact with the floor or underlying surface. The height or thickness 39 of the projections 25-32 is selected to help prevent the projections from deforming or deflection under pressure and to provide adequate depth to the channels 22 and 24 to quickly and efficiently direct fluids away from the projections 25-32.

Normally, the ball of an individual's foot exerts substantially more downward pressure onto a shoe or footwear than other parts of a foot. Thus, in turn, the portion of the outsole beneath the ball of a foot would exert substantially more downward pressure onto a floor or other surface underlying a shoe or footwear. This extra pressure would tend to move fluids away from beneath the outsole of the footwear and the floor, thus assisting in preventing slipping of the footwear. The portions of the outsole which are not directly beneath the ball of the foot would tend to have less downward pressure exerted. Thus, there may not be sufficient downward pressure from the outsole of the footwear to remove all of the fluids beneath the footwear. The edges 36 of the projections 25-32 assist in directing the fluids away from the upper surfaces 34 of the projections in these portions of the outsole which are directly beneath the ball of a foot, thereby enabling the footwear to resist slipping in wet or smooth environments.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A slip resistant footwear outsole comprising:

an outsole for a slip resistant article of footwear, said outsole including a plurality of integrally molded chevron shaped treads projecting outwardly from said outsole, each said tread including a base portion having said chevron shape, said base portion forming about half of a height of said tread, sidewalls of said base portion being oriented substantially perpendicular with respect to an outermost ground engaging surface of said outsole, a plurality of projections extending outwardly from said base portion in a double chevron pattern, said double chevron pattern of projections being spaced apart to form a longitudinal channel therebetween, a side surface of each projection being substantially aligned with at least one side surface of said base portion, an outermost surface of said projections defining the height of said treads and forming a ground engaging surface of said treads, a first of said plurality of projections being substantially square in shape when viewed from the top, said first projection positioned at an apex of said chevron shaped base having two sides substantially aligned with a side surface of said base portion, a transverse channel positioned on the two opposite sides, said longitudinal and said transverse channel intersecting, at least one second projection positioned on each of said two opposite sides spaced apart from said first projection, each said second projection being rectangular in shape when viewed from the top, a longer side of said second rectangular projection being substantially aligned with said side surface of said base portion, a chevron shaped third projection, said third projection having an inner apex, said third projection inner apex being substantially aligned with an inner apex of said base, a pair of opposite sides of said third projection forming a portion of said longitudinal channel, said third projection including a pair of end surfaces, said end surfaces forming a portion of said transverse channel.

2. The slip resistant footwear outsole of claim 1 including a pair of fourth projections, said fourth projections positioned in substantial alignment with said second projections, each said fourth projection having a side surface substantially aligned with a side surface of said base portion, each said fourth projection having an end surface substantially aligned with an end surface of said base portion, a transverse channel positioned between an end surface of each said second projection and an end surface of each said fourth projection.

3. The slip resistant footwear outsole of claim 2 including a pair of fifth projections, said fifth projections positioned in substantial alignment with the arms of said third projection, each said fifth projection having a side surface substantially aligned with a side surface of said base portion, each said fifth projection having an end surface substantially aligned with an end surface of said base portion, a transverse channel positioned between an end surface of each said arm of said third projection and an end surface of each said fifth projection.

4. The slip resistant footwear outsole of claim 1, including a plurality of said chevron shaped treads whose apexes are arranged in a direction to face toward a front of said outsole.

5. The slip resistant footwear outsole of claim 1, wherein said first, second and third projections each include at least one perimeter edge, said at least one perimeter edge being constructed and arranged to direct fluids on a floor surface away from an upper surface of said first, second and third projections and into said longitudinal and transverse channels which extend between said projections.

6. The slip resistant footwear outsole of claim 1 including a heel secured to said outsole, said heel including a plurality of surface engaging tread members.

7. The slip resistant footwear outsole of claim 6 wherein said tread members on said heel are chevron shaped and a pattern of said tread members on said heel is a plurality of chevrons whose apexes are oriented in a direction to point toward a front of said outsole.

8. The slip resistant footwear outsole of claim 6 including an area on said outsole between a forward portion and said heel which does not have tread members secured thereto.

* * * * *